US010164345B2

(12) United States Patent
Petersson et al.

(10) Patent No.: US 10,164,345 B2
(45) Date of Patent: Dec. 25, 2018

(54) ANTENNA ARRANGEMENT

(71) Applicant: TELEFONAKTIEBOLAGET LM ERICSSON (PUBL), Stockholm (SE)

(72) Inventors: Sven Petersson, Sävedalen (SE); Fredrik Athley, Kullavik (SE); Bo Hagerman, Tyresö (SE)

(73) Assignee: TELEFONAKTIEBOLAGET LM ERICSSON (PUBL), Stockholm (SE)

( * ) Notice: Subject to any disclaimer, the term of this patent is extended or adjusted under 35 U.S.C. 154(b) by 120 days.

(21) Appl. No.: 15/302,268

(22) PCT Filed: Apr. 10, 2014

(86) PCT No.: PCT/EP2014/057263
§ 371 (c)(1),
(2) Date: Oct. 6, 2016

(87) PCT Pub. No.: WO2015/154809
PCT Pub. Date: Oct. 15, 2015

(65) Prior Publication Data

US 2017/0033470 A1 Feb. 2, 2017

(51) Int. Cl.

| | |
|---|---|
| ***H01Q 21/24*** | (2006.01) |
| ***H01Q 1/24*** | (2006.01) |
| ***H01Q 21/00*** | (2006.01) |
| ***H01Q 21/08*** | (2006.01) |

(52) U.S. Cl.
CPC ..... *H01Q 21/24* (2013.01); *H01Q 1/246* (2013.01); *H01Q 21/0006* (2013.01); *H01Q 21/08* (2013.01)

(58) Field of Classification Search
CPC ..... H01Q 21/24
See application file for complete search history.

(56) References Cited

U.S. PATENT DOCUMENTS

| | | | | |
|---|---|---|---|---|
| 2003/0162566 | A1 | 8/2003 | Shapira et al. | |
| 2004/0066333 | A1 | 4/2004 | Judd et al. | |
| 2009/0066595 | A1* | 3/2009 | Barker | H01Q 1/246 343/757 |

FOREIGN PATENT DOCUMENTS

| | | | |
|---|---|---|---|
| DE | 102012012090 | A1 | 12/2013 |
| WO | 2006136793 | A1 | 12/2006 |
| WO | 2008020178 | A1 | 2/2008 |

OTHER PUBLICATIONS

International Search Report and Written Opinion dated Dec. 18, 2014, in International Application No. PCT/EP2014/057263, 9 pages.

* cited by examiner

*Primary Examiner* — Graham Smith
(74) *Attorney, Agent, or Firm* — Rothwell, Figg, Ernst & Manbeck, P.C.

(57) ABSTRACT

There is presented an antenna arrangement with P polarization directions. The antenna arrangement comprises M transmission (Tx) ports and N reception (Rx) ports, where M≠N. The antenna arrangement comprises an antenna panel divided into S subpanels, where S=max (M, N)/P. The subpanels are, for each polarization direction, operatively connected to separate radio chains for the N Rx ports if N>M or for the M Tx ports if M>N.

22 Claims, 8 Drawing Sheets

ANTENNA ARRANGEMENT

CROSS REFERENCE TO RELATED APPLICATION(S)

This application is a 35 U.S.C. § 371 National Phase Entry Application from PCT/EP2014/057263, filed Apr. 10, 2014, designating the United States, the disclosure of which is incorporated herein in its entirety by reference.

TECHNICAL FIELD

Embodiments presented herein relate to antenna arrangements, and particularly to antenna arrangements with P polarization directions and with unequal number of transmission ports and receiver ports.

BACKGROUND

In communications networks, it may be challenging to obtain good performance and capacity for a given communications protocol, its parameters and the physical environment in which the communications network is deployed.

One component of wireless communications networks where it may be challenging to obtain good performance and capacity is the antennas of network nodes configured for wireless communications; either to/from another network node, and/or to/from a wireless user terminal. For example, a significant portion of network nodes deployed today are equipped with two reception (Rx) branches; in many cases by means of dual polarized antennas.

Demands for improved uplink performance sometimes require the number of Rx branches to be increased to four (or more), which often means that an extra antenna is mounted at the network nodes. Alternatively the existing antenna may be replaced with, for example, a quad (dual column, dual polarized) antenna.

Both these options result in an increased total antenna area. The increased total antenna area given by either mounting an additional antenna or replacing the existing antenna with a new antenna is in some cases not acceptable, especially at lower frequencies where antenna areas are quite large.

Hence, there is a need for an improved antenna arrangement.

SUMMARY

An object of embodiments herein is to provide an improved antenna arrangement.

According to a first aspect there is presented an antenna arrangement with P polarization directions. The antenna arrangement comprises M transmission (Tx) ports and N reception (Rx) ports, where $M \neq N$. The antenna arrangement comprises an antenna panel divided into S subpanels, where $S=\max(M, N)/P$. The subpanels are, for each polarization direction, operatively connected to separate radio chains for the N Rx ports if $N>M$ or for the M Tx ports if $M>N$.

Advantageously this provides an improved antenna arrangement.

Advantageously this provides an antenna arrangement with equal or better performance than existing antenna arrangements.

Advantageously, this, for example, enables an antenna arrangement with 2 Tx ports and 4 Rx ports within the same area as a conventional antenna arrangement with 2 Tx ports and 2 Rx ports.

According to a second aspect there is presented a network node comprising an antenna arrangement according to the first aspect.

According to a third aspect there is presented a wireless terminal comprising an antenna arrangement according to the first aspect.

It is to be noted that any feature of the first, second, and third aspects may be applied to any other aspect, wherever appropriate. Likewise, any advantage of the first aspect may equally apply to the second, and/or third aspect, respectively, and vice versa. Other objectives, features and advantages of the enclosed embodiments will be apparent from the following detailed disclosure, from the attached dependent claims as well as from the drawings.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

BRIEF DESCRIPTION OF THE DRAWINGS

The inventive concept is now described, by way of example, with reference to the accompanying drawings, in which.

DETAILED DESCRIPTION

The inventive concept will now be described more fully hereinafter with reference to the accompanying drawings, in which certain embodiments of the inventive concept are shown. This inventive concept may, however, be embodied in many different forms and should not be construed as limited to the embodiments set forth herein; rather, these embodiments are provided by way of example so that this disclosure will be thorough and complete, and will fully convey the scope of the inventive concept to those skilled in the art. Like numbers refer to like elements throughout the description. Any step or feature illustrated by dashed lines should be regarded as optional.

The embodiments disclosed herein relate to antenna arrangements with P polarization directions and with unequal number of transmission ports and receiver ports. General references are now made to FIGS. 1-7 illustrating antenna arrangements 1*a*, 1*b*, 1*c*, 1*d*, 1*e*, 1*f*, 1*g* with P polarization directions, where P=1 or where P=2.

Figure 1:
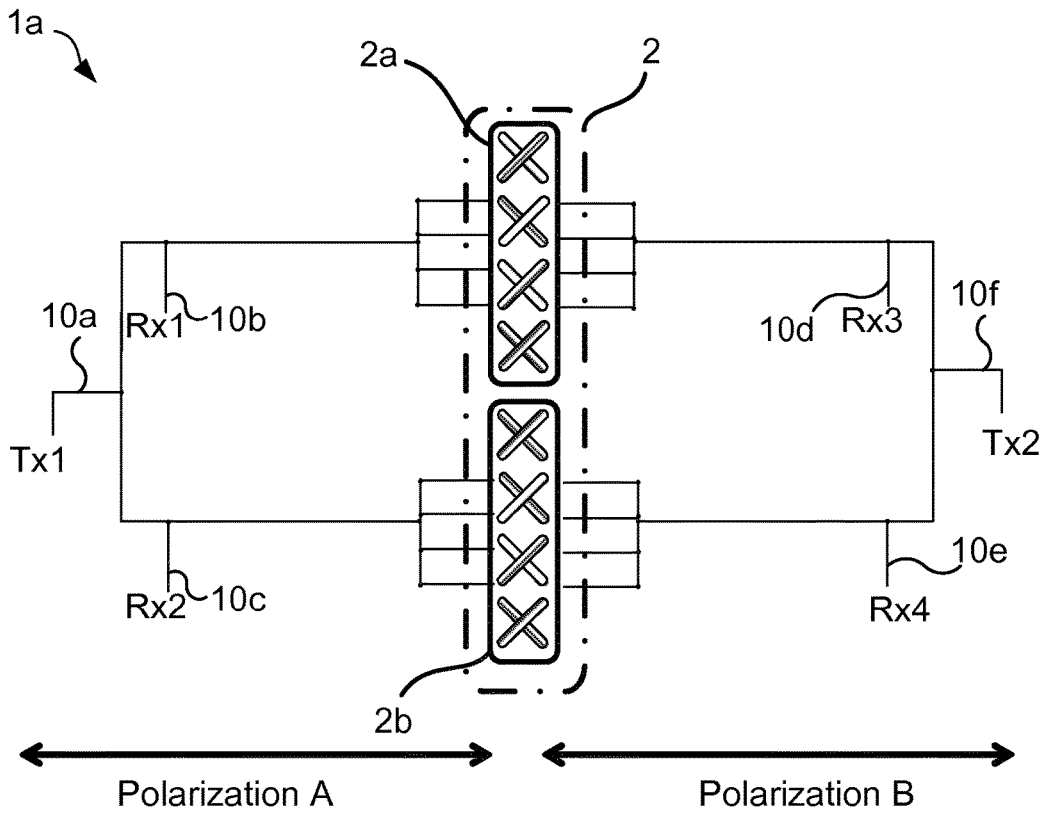
FIGS. 1 to 7 are schematic diagrams illustrating antenna arrangements according to embodiments.

Particular reference is made to FIG. 1 illustrating an antenna arrangement 1*a* according to an embodiment. The antenna arrangement 1*a* of FIG. 1 has 2 polarization directions. In general terms, the herein disclosed antenna arrangements have P polarization directions where P=1 or P=2.

The antenna arrangement 1*a* comprises two transmission (Tx) ports, Tx1, and Tx2. In general terms, the herein disclosed antenna arrangements have M transmission ports.

The antenna arrangement 1*a* comprises four reception (Rx) ports, Rx1, Rx2, Rx3, and Rx4. In general terms, the herein disclosed antenna arrangements have N reception ports, where M≠N. That is, the number of Tx ports is different from the number of Rx ports.

The antenna arrangement 1*a* comprises an antenna panel 2. The herein disclosed embodiments are based on splitting the antenna panel 2 into at least two subpanels. The antenna panel 2 of the antenna arrangement 1*a* is divided into two subpanels 2*a*, 2*b*. In general terms, the herein disclosed antenna arrangements have S subpanels, where S=max (M, N)/P. That is, the number of subpanels S is equal to the maximum of the number of Tx ports and the number of Rx ports divided by the number of polarization directions.

The subpanels 2*a*, 2*b*, are for each polarization direction operatively connected to separate radio chains 10*a*, 10*b*, 10*c*, 10*d*, 10*e*, 10*f* for the N Rx ports if N>M or for the M Tx ports if M>N. For the antenna arrangement 1*a* N=4 and M=2 and hence the subpanels 2*a*, 2*b*, are for each polarization direction operatively connected to separate radio chains 10*b*, 10*c*, 10*d*, 10*e* for the four Rx ports.

The disclosed antenna arrangement 1*a* may for example offer 2 Tx ports and 4 Rx ports within the same area as a conventional 2 Tx and 2 Rx antenna.

Further details of the herein disclosed antenna arrangements will now be disclosed with continued references to the antenna arrangements 1*a*, 1*b*, 1*c*, 1*d*, 1*e*, 1*f*, 1*g* of FIGS. 1-7.

In general terms, the herein disclosed antenna arrangement may according to some embodiments comprise two (or more) single or dual polarized subpanels 2*a-d* stacked on top of each other and/or placed beside each other. These subpanels are operatively connected to unequal number of Tx ports and Rx ports. For example, although the subpanels 2*a-d* of each of the herein disclosed antenna arrangements for simplicity are described as being identical, in the general case they may not be identical, for example containing a different number of antenna elements per subpanels.

There may be more Rx ports than Tx ports. That is according to an embodiment, N>M. This is the case for the antenna arrangements 1*a*, 1*b*, 1*c*, 1*d*, 1*e* (and depending on the actual configuration used, possible also for antenna arrangement 1*g*). There may be more Tx ports than Rx ports. That is according to an embodiment, M>N. This is the case for the antenna arrangement 1*f* (and depending on the actual configuration used, possible also for antenna arrangement 1*g*). The number of Tx ports and/or Rx ports may be based on the number of polarizations. Particularly, according to an embodiment, min (M, N)≥P. That is, the minimum of the number of Tx ports and the number of Rx ports may be larger than or equal to the number of polarization directions. Further, min (M, N) may be a multiple of P.

According to an embodiment the antenna panel 2 is a one-dimensional antenna array. FIGS. 1-5 illustrate such antenna arrangements 1*a*-1*e*.

Figure 6:
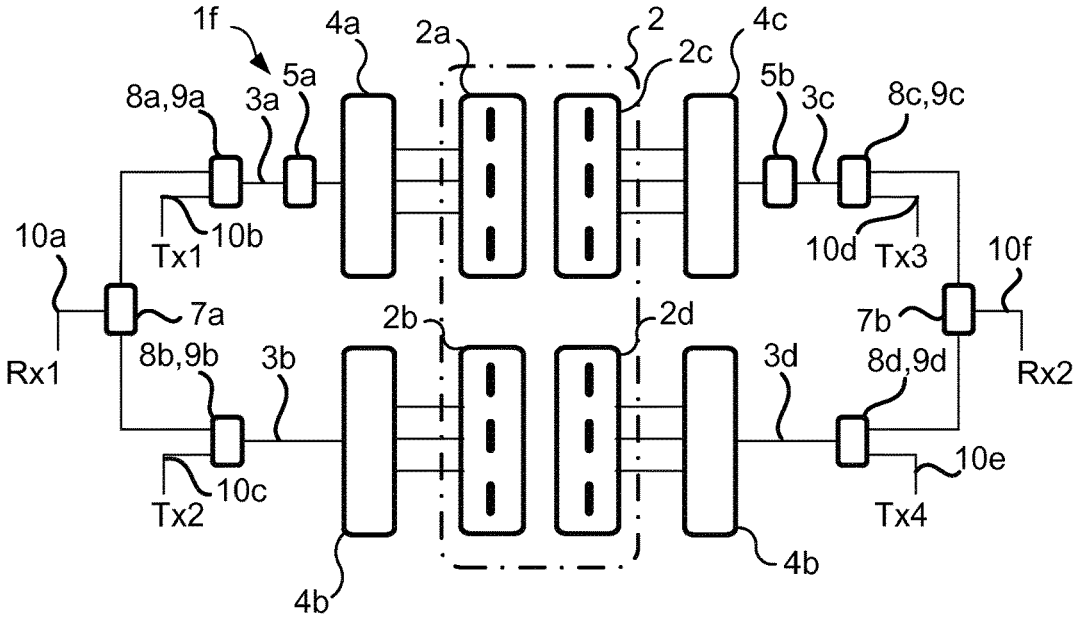
Figure 7:
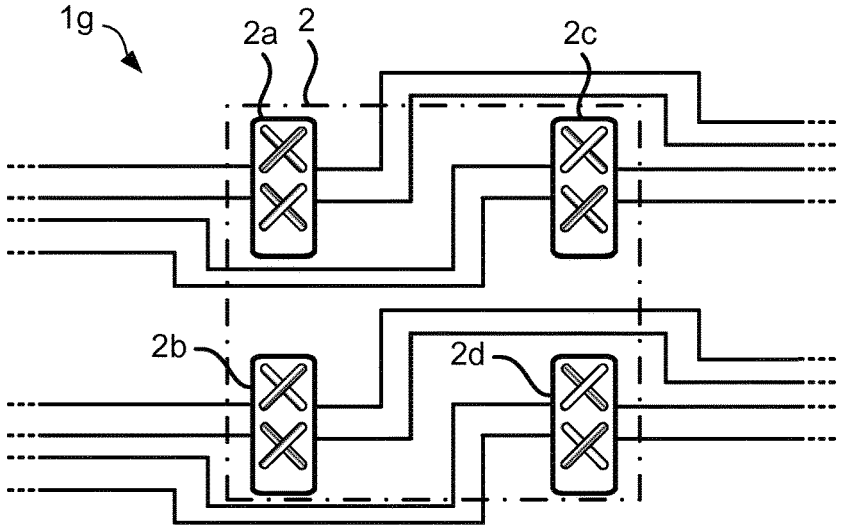

According to an embodiment the antenna panel 2 is a two-dimensional antenna array. FIGS. 6 and 7 illustrate such antenna arrangements 1*f*-1*g*.

According to an embodiment all subpanels 2*a-d* are identical. According to an alternative embodiment the antenna arrangement 1*a*, 1*b*, 1*c*, 1*d*, 1*e*, 1*f*, 1*g* comprises at least two different types of subpanels. Hence, all subpanels 2*a-d* may or may not have identical elements and/or components.

In general terms, any of the herein disclosed antenna arrangements may comprise additional functional blocks, such as any of distribution networks, phase shifters, splitter modules or combiner modules, and duplex modules or switch modules. Two or more of these functional blocks may be implemented in the same physical building block. Such further details of the herein disclosed antenna arrangements will now be disclosed with continued references to the antenna arrangements 1*b*, 1*c*, 1*d*, 1*e*, 1*f*, 1*g* of FIGS. 2-7.

According to some embodiments the antenna arrangement 1*b*, 1*c*, 1*d*, 1*e*, 1*f*, 1*g* further comprises separate distribution networks 4*a*, 4*b*, 4*c*, 4*d*, 4*e*, 4*f*, 4*g*, 4*h* for each subpanel 2*a*, 2*b*, 2*c*, 2*d* and for each polarization direction. The separate distribution networks 4*a*, 4*b*, 4*c*, 4*d*, 4*e*, 4*f*, 4*g*, 4*h* are operatively connected between the subpanels 2*a*, 2*b*, 2*c*, 2*d* and the radio chains 10*a-h*. The separate distribution networks 4*a*, 4*b*, 4*c*, 4*d*, 4*e*, 4*f*, 4*g*, 4*h* may be configured for at least one of amplitude tapering and variable phase shifting (electrical tilt). For example, the separate distribution networks 4*a*, 4*b*, 4*c*, 4*d*, 4*e*, 4*f*, 4*g*, 4*h* may be configured for a fixed amplitude and phase plus variable phase shifting. For example, the separate distribution networks 4*a*, 4*b*, 4*c*, 4*d*, 4*e*, 4*f*, 4*g*, 4*h* may be configured for fixed phase tapering.

The distribution networks 4*a*, 4*b*, 4*c*, 4*d*, 4*e*, 4*f*, 4*g*, 4*h* may have the same or different settings. Thus, according to some embodiments at least two of the distribution networks have different settings. For example, at least two of the distribution networks may have different tilt settings. Alternatively the separate distribution networks 4*a*, 4*b*, 4*c*, 4*d*, 4*e*, 4*f*, 4*g*, 4*h* may be configured for fixed tilt and/or for fixed phase tapering. The distribution network, per subpanel, may apply desired amplitude and phase taper to create desired properties such as beam shaping. For example, the phase taper may be variable to achieve desired variable beam properties such as null-fill. The joint distribution network 4*a*, 4*b*, 4*c*, 4*d*, 4*e*, 4*f*, 4*g*, 4*h* may, over all subpanels 2*a*, 2*b*, 2*c*, 2*d*, create a joint common beam shape/property for the joint set of antenna elements over all subpanels, which may be desired for Tx, whilst being different for each subpanel or set of subpanels for Rx.

According to some embodiments the antenna arrangement 1*b*, 1*c*, 1*d*, 1*e*, 1*f*, 1*g* further comprises separate phase shifters 5*a*, 5*b*, 5*c*, 5*d*, 5*e*, 5*f*. Particularly, all but one subpanel may, for each polarization direction, be operatively connected to a separate phase shifter 5*a*, 5*b*, 5*c*, 5*d*, 5*e*, 5*f* between the subpanels 2*a*, 2*b*, 2*c*, 2*d* and the radio chains 10*a-h*. The phase shifter 5*a*, 5*b*, 5*c*, 5*d*, 5*e*, 5*f* should be regarded as functional blocks and may as such be implemented in separate circuitry or joint with other components of the antenna arrangement 1*b*, 1*c*, 1*d*, 1*e*, 1*f*, 1*g*. For example, the phase shifters 5*a*, 5*b*, 5*c*, 5*d*, 5*e*, 5*f* may be integrated with the distribution networks 4*a*, 4*b*, 4*c*, 4*d*, 4*e*, 4*f*, 4*g*, 4*h*. If implemented separately the distribution networks 4*a*, 4*b*, 4*c*, 4*d*, 4*e*, 4*f*, 4*g*, 4*h* may be operatively connected between the subpanels 2*a*, 2*b*, 2*c*, 2*d* and the phase shifters 5*a*, 5*b*, 5*c*, 5*d*, 5*e*, 5*f*.

According to some embodiments the antenna arrangements disclosed herein further comprises at least one splitter module or at least one combiner module (per polarization). Particular details related thereto will now be disclosed.

The antenna arrangements disclosed herein may further comprise, if N>M, at least one splitter module 6*a*, 6*b*, 6*c*, 6*d*. That is, the antenna arrangements disclosed herein may further comprise at least one splitter module 6*a*, 6*b*, 6*c*, 6*d* if the number of Rx ports is larger than the number of Tx ports. The at least one splitter module 6*a*, 6*b*, 6*c*, 6*d* is configured to split a Tx signal of one Tx radio chain into at least two Tx signals, each one of which is provided to a separate one of the subpanels 2*a*, 2*b*, 2*c*, 2*d*. The splitter modules 6*a*, 6*b*, 6*c*, 6*d* may be configured for equal or non-equal power splitting. Particularly, the at least one splitter module may be configured for non-equal power splitting of the one Tx radio chain. For N>M the subpanels (all or a subset larger than 1) may thus on Tx be fed with the same signal via a splitter module 6*a*, 6*b*, 6*c*, 6*d* and tilt device whereas on Rx each subpanel is individually accessible. The antenna arrangements disclosed herein may alternatively further comprise, if M>N, at least one combiner module 7*a*, 7*b*. That is, the antenna arrangements disclosed herein may further comprise at least one combiner module 7*a*, 7*b* if the number of Tx ports is larger than the number of Rx ports.

The at least one combiner module 7*a*, 7*b* is configured to combine at least two Rx signals received from separate ones of the subpanels 2*a*, 2*b*, 2*c*, 2*d* into one Rx signal of a joint Rx radio chain. For M>N the receivers (all or a subset larger than 1) may thus on Rx receive a combined signal via a combiner module 7*a*, 7*b* and tilt device whereas on Tx each subpanel is individually accessible.

According to some embodiments the antenna arrangements disclosed herein further comprises at least one duplex module or at least one switch module. Particular details related thereto will now be disclosed.

The antenna arrangements disclosed herein may further comprise at least one duplex module 8*a*, 8*b*, . . . , 8*h*. The at least one duplex module 8*a*, 8*b*, . . . , 8*h* is configured to perform frequency domain separation of one Tx signal received from one of the Tx radio chains and one Rx signal received from one of the subpanels 4*a-h*. Such arrangements may thus be suitable for frequency-division duplexing (FDD) of the Tx signals and the Rx signals. The antenna arrangements disclosed herein may alternatively further comprise at least one switch module 9*a*, 9*b*, . . . , 9*h*. The at least one switch module 9*a*, 9*b*, . . . , 9*h* is configured to perform time domain separation of one Tx signal received from one of the Tx radio chains and one Rx signal received from one of the subpanels. Such arrangements may thus be suitable for time-division duplexing (TDD) of the Tx signals and the Rx signals.

Figure 2:
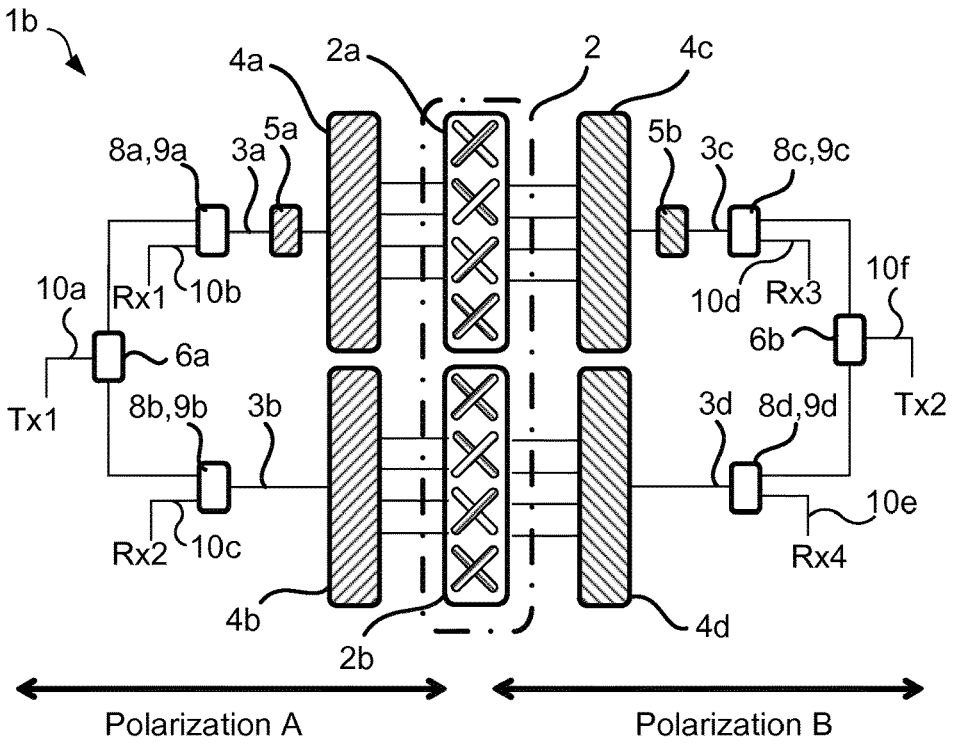

Particular reference is now made to FIG. 2 illustrating an antenna arrangement 1*b* with P=2 polarization directions, where N=4, where M=2, and where S=2. In more detail the antenna arrangement 1*b* comprises two dual polarized antenna subpanels 2*a*, 2*b* mounted vertically on top of each other. Each polarization in each subpanel 2*a*, 2*b* is operatively connected to a distribution network 4*a*, 4*b*, 4*c*, 4*d* configured for amplitude tapering and variable phase shifting in order to give the desired tilt and beam shape for the subpanel it is operatively connected to. In many applications the tilt setting will be the same for both subpanels 2*a*, 2*b* but there is no requirement for that and the subpanels 2*a*, 2*b* could thus be set individually. Different tilt settings may be used for affecting the beam shape. By means of phase shifters 5*a*, 5*b* in the upper branches of each polarization direction the phase for the two subpanels 2*a*, 2*b* is set to a desired value, typically to generate a total amplitude and phase distribution of the transmit signal over the entire antenna panel 2, for example to align the phase fronts from the two subpanels 2*a*, 2*b* according to a tilt setting. The phase shifters 5*a*, 5*b* may alternatively be placed in the lower branches of each polarization direction, or one in an upper branch and one in a lower branch, etc. In general terms, there is no need for separate phase shifters 5*a*, 5*b*; the functionality thereof may be included in the distribution networks 4*a*, 4*c* (and/or 4*b*, 4*d*). Two duplex modules 8*a-d* or switch modules 9*a-d* per polarization are used to separate the Rx signal from each subpanel and polarization direction into separate Rx signals Rx1, Rx2, Rx3, Rx4 (in order to enable desired isolation between the Tx signals and the Rx signals) as provided to the radio chains 10*b*, 10*c*, 10*d*, 10*e*. Finally, one splitter module 6*a*, 6*b* per polarization direction is used to generate two Tx signals (one per subpanel) from a single Tx input signal Tx1, Tx2 for each polarization direction as received on the radio chains 10*a*, 10*f*.

Figure 3:
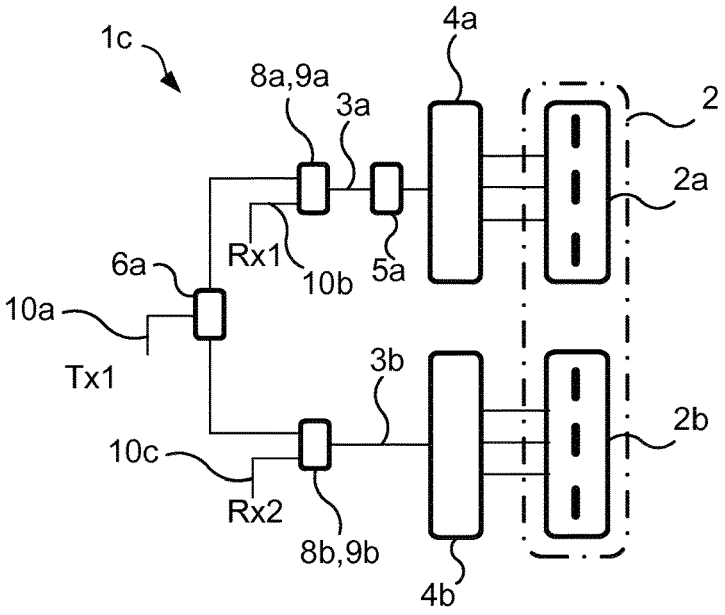

Particular reference is now made to FIG. 3 illustrating an antenna arrangement 1*c* with P=1 polarization direction, where N=2, where M=1, and where S=2. The antenna arrangement 1*c* of FIG. 3 thus differs from the antenna arrangement 1*b* of FIG. 2 in that the antenna arrangement 1*c* of FIG. 3 comprises two single polarized antenna subpanels 2*a*, 2*b* mounted vertically on top of each other. Each subpanel 2*a*, 2*b* is operatively connected to a distribution network 4*a*, 4*b* configured for amplitude tapering and variable phase shifting in order to give the desired tilt and beam shape for the subpanel it is operatively connected to. By means of a phase shifter 5*a* in one branch (according to the illustrative example of FIG. 3 the upper branch) the phase for the two subpanels 2*a*, 2*b* is set to a desired value, typically to generate a total amplitude and phase distribution of the transmit signal over the entire antenna panel 2, including tilt setting per subpanel 2*a*, 2*b*, for example to align the phase fronts from the two subpanels 2*a*, 2*b* according to a tilt setting. Two duplex modules 8*a*, 8*b* or switch modules 9*a*, 9*b* are used to separate the Rx signal from each subpanel 2*a*, 2*b* into separate Rx signals Rx1, Rx2 (in order to enable desired isolation between the Tx signals and the Rx signals) as provided to the radio chains 10*b*, 10*c*. Finally, one splitter module 6*a* is used to generate two Tx signals (one per subpanel) from a single Tx input signal Tx1 as received on the radio chain 10*a*.

Figure 4:
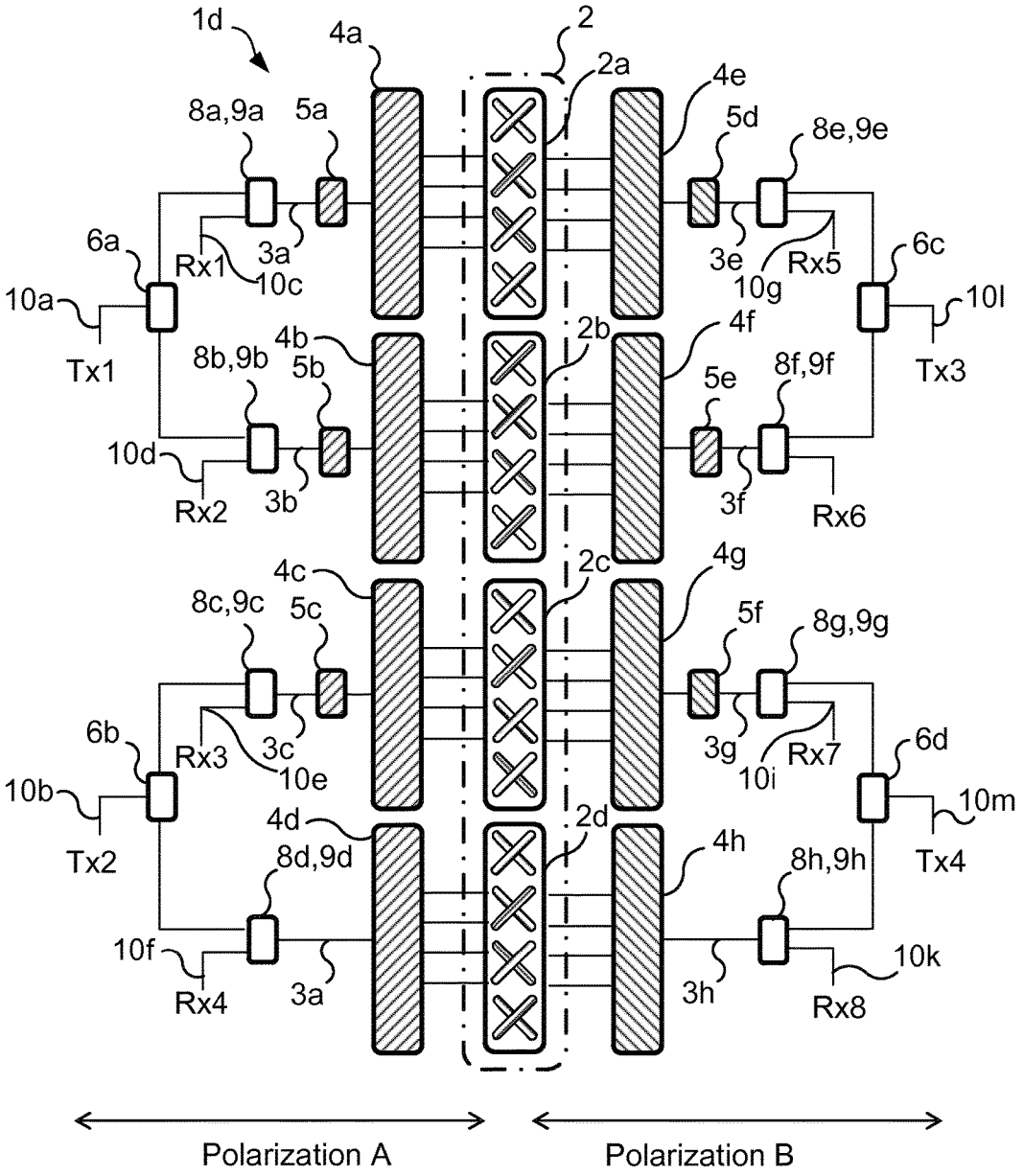

Particular reference is now made to FIG. 4 illustrating an antenna arrangement 1*d* with P=2 polarization directions, where N=8, where M=4, and where S=4. The antenna arrangement 1*d* of FIG. 4 thus differs from the antenna arrangement 1*b* of FIG. 2 in that the antenna arrangement 1*d* of FIG. 4 comprises four dual polarized antenna subpanels 2*a*, 2*b*, 2*c*, 2*d* mounted vertically on top of each other. Further, the antenna arrangement 1*d* of FIG. 4 additionally comprises separate phase shifters 5*a*, 5*b*, 5*c*, 5*d*, 5*e*, 5*f* for all but the bottom two subpanels 2*d*, 2*h* for each polarization direction. Each pair of subpanels, i.e., subpanels 2*a* and 2*b*, subpanels 2*c* and 2*d*, subpanels 2*e* and 2*f*, and subpanels 2*g* and 2*h* are operatively connected to a common Tx radio chain 10*a*, 10*b*, 10*l*, 10*m*, thus enabling four Tx signals Tx1, Tx2, Tx3, Tx4 to be transmitted.

Figure 5:
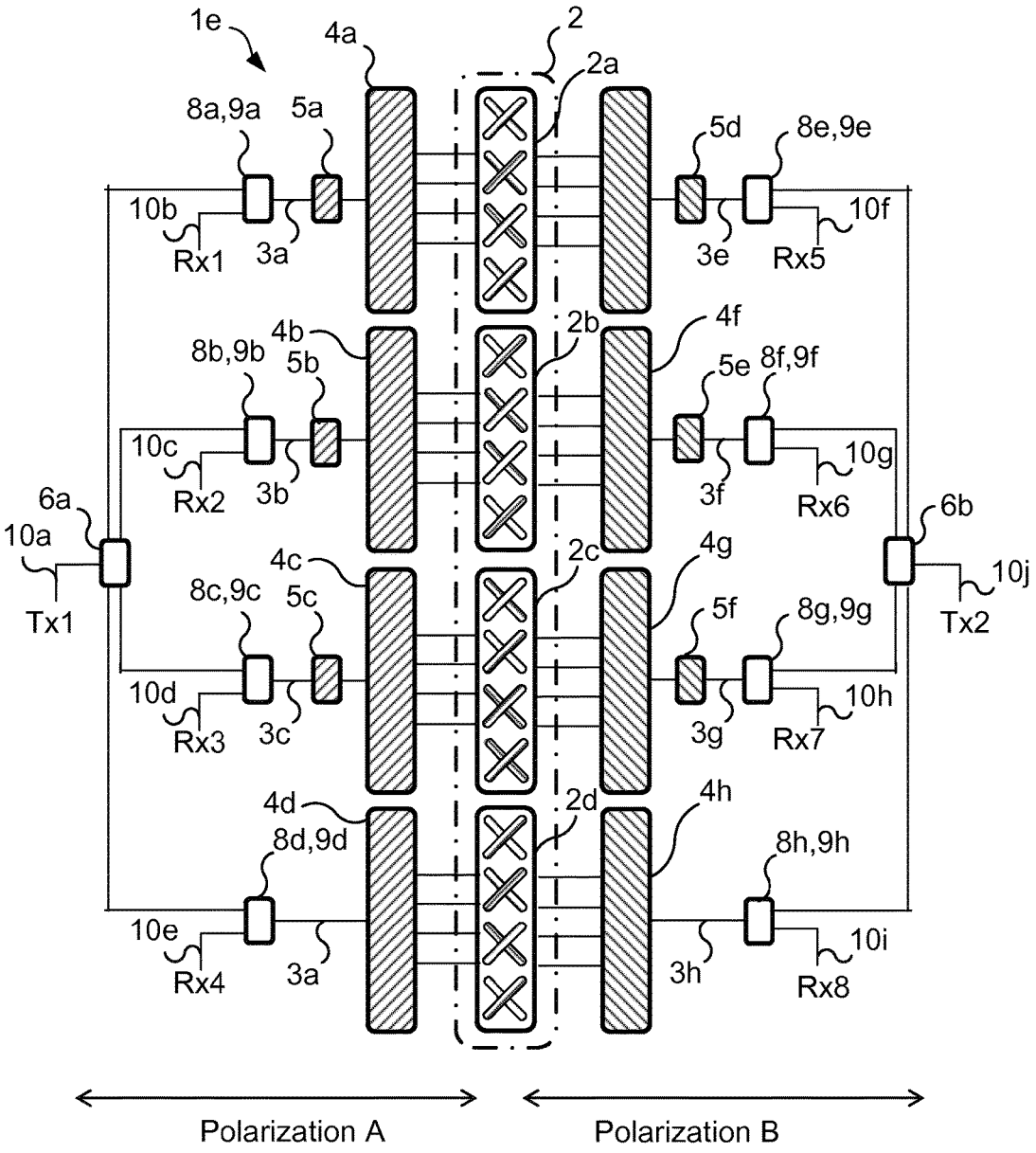

Particular reference is now made to FIG. 5 illustrating an antenna arrangement 1*e* with P=2 polarization directions, where N=8, where M=2, and where S=4. The antenna arrangement 1*e* of FIG. 5 thus differs from the antenna arrangement 1*d* of FIG. 4 in that according to the antenna arrangement 1*e* of FIG. 5 all subpanels, for each polarization direction, are operatively connected to one Tx radio chain 10*a*, 10*bj*, thus enabling two Tx signals Tx1, Tx2, to be transmitted.

Particular reference is now made to FIG. 6 illustrating an antenna arrangement 1*f* with P=1 polarization direction, where N=2, where M=4, and where S=4. The antenna arrangement 1*f* of FIG. 6 thus differs from the antenna arrangement 1*c* of FIG. 3 firstly in that the antenna arrangement 1*f* of FIG. 6 comprises a two-dimensional antenna panel 2 divided into four single polarized antenna subpanels 2*a*, 2*b*, 2*c*, 2*d* pairwise mounted vertically on top of each other. The antenna arrangement 1*f* of FIG. 6 further differs from the antenna arrangement 1*c* of FIG. 3 in that the antenna arrangement 1*f* of FIG. 6 comprises two combiner modules 7*a*, 7*b* instead of one splitter module 6*a*. The antenna arrangement 1*f*of FIG. 6 further differs from the antenna arrangement 1*c* of FIG. 3 in that the antenna arrangement 1*f*of FIG. 6 comprises more Tx ports (Tx1, Tx2, Tx3, Tx4 connected via radio chains 10*b*, 10*c*, 10*d*, and 10*e*, respectively) than Rx ports (Rxl, Rx2 connected via radio chains 10*a*, 10*f*). The antenna arrangement 1*f* of FIG. 6 thus enables reception of two Rx signals and transmission of four Tx signals.

Particular reference is now made to FIG. 7 illustrating an antenna arrangement 1*g* with P=2 polarization directions, and where S=4. According to the embodiment illustrated in FIG. 7, the antenna panel 2 is a two-dimensional antenna array and comprises subpanels 2*a*, 2*b*, 2*c*, 2*d*. Depending on the actual configuration desired, the antenna arrangement 1*g* may be used either as an antenna arrangement with N=8 and M=2 or M=4, or with M=8 and N=2 or N=4.

Figure 8:
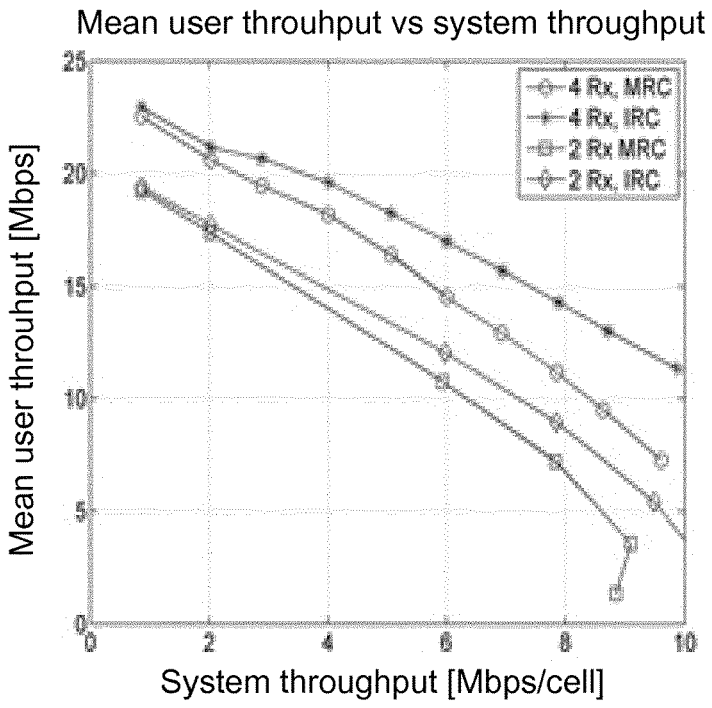
FIGS. 8 to 14 show simulation results according to embodiments.
Figure 9:
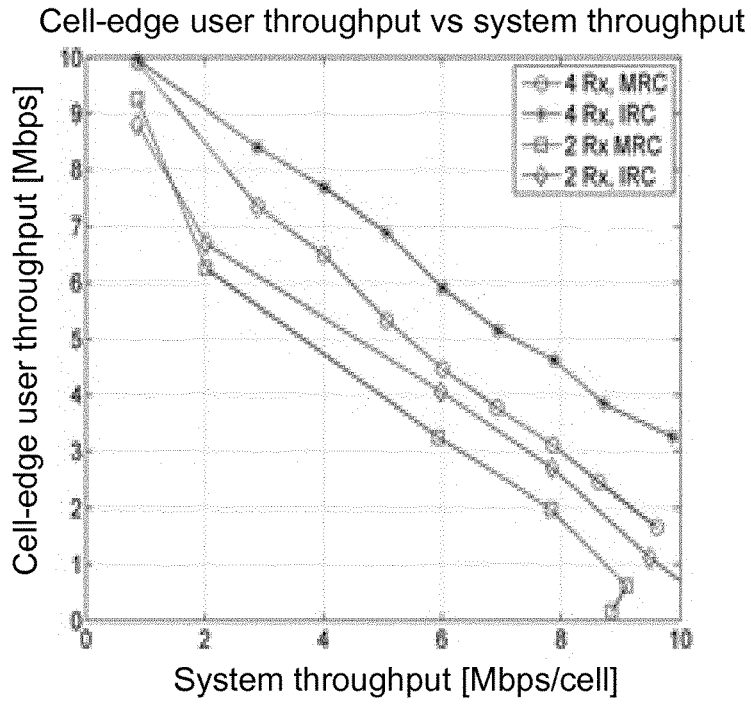

FIG. 8 provides simulation results of mean user throughput (in Mbps) as a function of system throughput (in Mbps per cell) in a 3GPP case 1 scenario (uplink). FIG. 9 provides simulation results of cell-edge (5%-ile) user throughput (in Mbps) as a function of system throughput (in Mbps per cell) in a 3GPP case 1 scenario (uplink). Further, results are provided for both maximum ratio combining (MRC) receivers and interference rejection combing (IRC) receivers, respectively. Table 1 summarizes some of the simulation parameters used.

TABLE 2

| Simulation parameters used for results in FIGS. 8 and 9 | |
|---|---|
| Simulation scenario | 3GPP case 1 |
| System bandwidth | 10 MHz |
| Channel model | 3GPP SCM urban macro |
| Traffic model | Equal buffer file upload |
| Number of antenna radiating elements (per polarization) | 8 |
| Antenna element separation | 0.7 wavelengths |
| Antenna gain | 18 dBi |

In more detail, FIGS. 8 and 9 show a performance comparison of the proposed antenna arrangement, in the plots referred to as "4 Rx", and a conventional 2 Rx antenna, referred to as "2 Rx", obtained from system simulations of a 3GPP case 1 scenario. The proposed antenna arrangement and the conventional antenna arrangement have the same antenna area.

The results in FIGS. 8 and 9 show that the proposed 4 Rx antenna arrangement offers substantial performance improvements over the conventional 2 Rx antenna.

FIGS. 10, 11, 12, 13, and 14 show further beam pattern examples for the proposed antenna arrangements. In FIGS. 10 to 14 it is assumed that the proposed antenna arrangements are provided in a network node providing network coverage to a wireless terminal.

Table 2 summarizes some of the parameters valid for FIGS. 10 to 14.

TABLE 2

| Simulation parameters used for results in FIGS. 10 to 14 | |
|---|---|
| Element half-power beamwidth | 90 degrees |
| Number of antenna radiating elements (per polarization) | 8 |
| Antenna element separation | 0.7 wavelengths |

Figure 10:
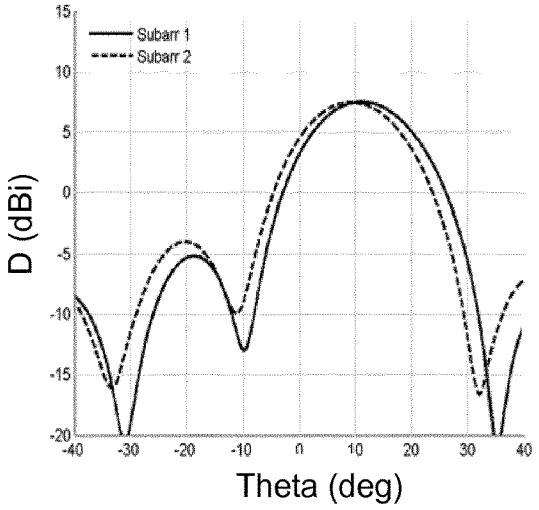
Figure 11:
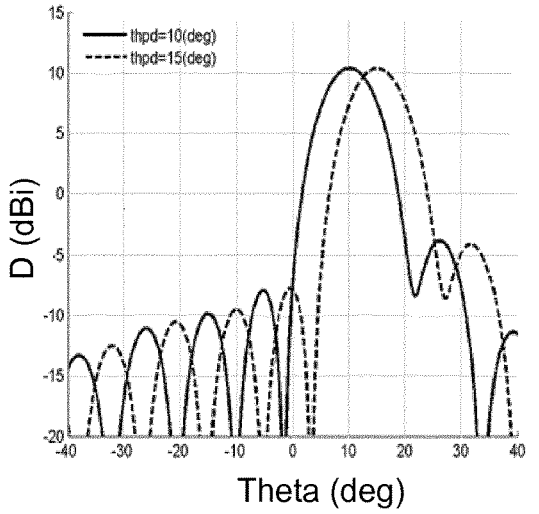

In all plots except the dashed curve in FIG. 11 the phase taper for the subpanels, including tilt setting, is designed for a desired pointing direction of 10 degrees in downlink FIG. 10 shows subpanel patterns. The patterns are not perfectly identical since a taper is applied over all elements in the antenna panel to give a desired downlink beam pattern FIG. 11 shows downlink (DL) beam examples for different tilt settings.

Figure 12:
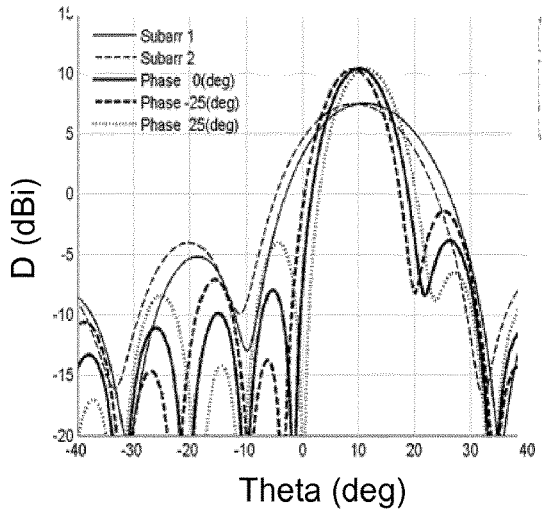
Figure 13:
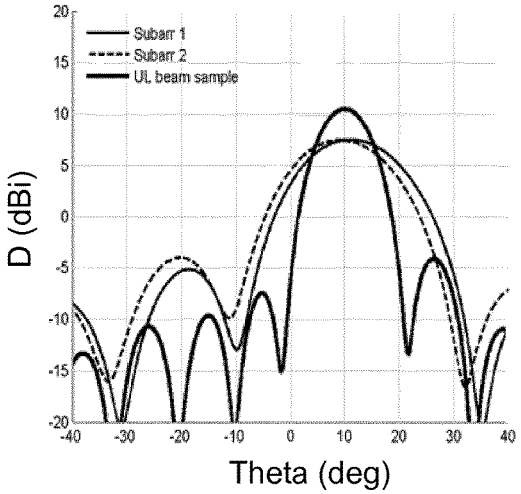

FIG. 12 shows downlink beam examples for different settings of the external phase shifters. The phase shift for the subpanels is given for a pointing direction of 10 degrees. Changing this phase may only affect the downlink since the phase shift can be compensated for in uplink. FIG. 12 thus shows an example of how the downlink beam pattern can be changed, for example to affect the sidelobes, by adjusting the external phase shifters FIG. 13 shows the resulting uplink (UL) beam after MRC combination for a wireless terminal location of 10 degrees. The tilt setting for the subpanels is given by a desired beam pointing direction in the downlink of 10 degrees.

Figure 14:
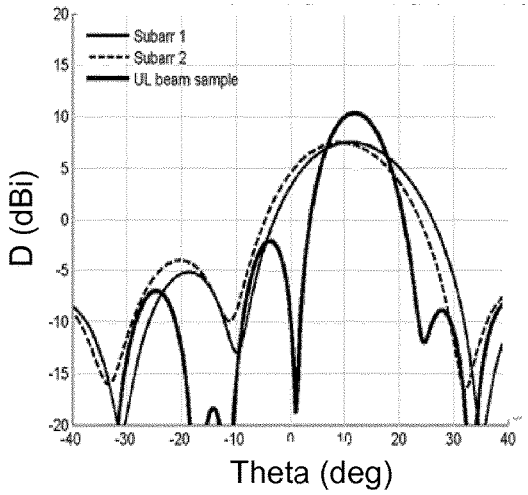

FIG. 14 shows an example of UL beams after MRC combination for a wireless terminal location of 12.5 degrees. The tilt setting for the subpanels is given by a desired beam pointing of 10 degrees.

Figure 15:
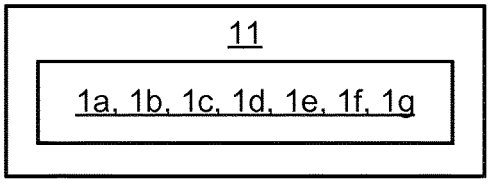
FIG. 15 schematically illustrates a network node comprising an antenna arrangement according to embodiments.
Figure 16:
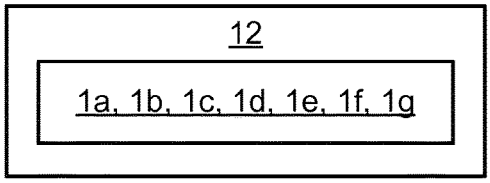
FIG. 16 schematically illustrates a wireless terminal comprising an antenna arrangement according to embodiments.

The antenna arrangements 1*a-g* may be provided as standalone circuitry or as a part of a device. For example, any of the antenna arrangements 1*a-g* may be provided in a network node 11. FIG. 15 schematically illustrates a network node 11 comprising any one of the herein disclosed antenna arrangements 1*a-g*. The network node 11 may be a radio base station, such as a base transceiver station, a Node B, an Evolved Node B, a repeater, a relay, or the like. For example, any of the antenna arrangements 1*a-g* may be provided in a wireless terminal 12. FIG. 16 schematically illustrates a wireless terminal 12 comprising any one of the herein disclosed antenna arrangements 1*a-g*. The wireless terminal 12 may be a mobile phone, a user equipment, a smartphone, a tablet computer, a laptop computer, or the like. The antenna arrangement 1*a-g* may be provided as an integral part of the network node 11 or the wireless terminal 12. That is, the components of the antenna arrangement 1*a-g* may be integrated with other components of the network node 11 or wireless terminal 12; some components of the network node 11 or wireless terminal 12 and the antenna arrangement 1*a-g* may be shared.

The inventive concept has mainly been described above with reference to a few embodiments. However, as is readily appreciated by a person skilled in the art, other embodiments than the ones disclosed above are equally possible within the scope of the inventive concept, as defined by the appended patent claims.

The invention claimed is:

1. An antenna arrangement with P polarization directions, comprising:

M transmission, Tx, ports and N reception, Rx, ports, where M≠N; and an antenna panel divided into S subpanels, where S=max (M, N)/P, wherein the subpanels, for each polarization direction, are operatively connected to separate radio chains for the N Rx ports if N>M or for the M Tx ports if M>N, wherein if N>M and S>1 each Tx port is operatively connected to at least two of the subpanels for each polarization direction, and wherein if M<N and S>1 each Rx port is operatively connected to at least two of the subpanels for each polarization direction.

2. The antenna arrangement according to claim 1, further comprising separate distribution networks for each subpanel and for each polarization direction, the separate distribution networks being operatively connected between the subpanels and the radio chains, and configured for at least one of amplitude tapering and variable phase shifting.

3. The antenna arrangement according to claim 2, wherein at least two of the distribution networks have different tilt settings.

4. The antenna arrangement according to claim 2, wherein at least two of the distribution networks have different settings.

5. The antenna arrangement according to claim 1, wherein all but one subpanel, for each polarization direction, are operatively connected to a separate phase shifter between the subpanels and the radio chains.

6. The antenna arrangement according to claim 5, wherein the distribution networks are operatively connected between the subpanels and the phase shifters.

7. The antenna arrangement according to claim 5, wherein the phase shifters are integrated with the distribution networks.

8. The antenna arrangement according to claim 1, if N>M further comprising at least one splitter module configured to split a Tx signal of one Tx radio chain into at least two Tx signals, each one of which is provided to a separate one of the subpanels.

9. The antenna arrangement according to claim 8, wherein the at least one splitter module is configured for non-equal power splitting of the one Tx radio chain.

10. The antenna arrangement according to claim 1, if M>N further comprising at least one combiner module configured to combine at least two Rx signals received from separate ones of the subpanels into one Rx signal of a joint Rx radio chain.

11. The antenna arrangement according to claim 1, further comprising at least one duplex module configured to perform frequency domain separation of one Tx signal received from one of the Tx radio chains and one Rx signal received from one of the subpanels.

12. The antenna arrangement according to claim 1, further comprising at least one switch module configured to perform time domain separation of one Tx signal received from one of the Tx radio chains and one Rx signal received from one of the subpanels.

13. The antenna arrangement according to claim 1, wherein all subpanels are identical.

14. The antenna arrangement according to claim 1, comprising at least two different types of subpanels.

15. The antenna arrangement according to claim 1, wherein N>M.

16. The antenna arrangement according to claim 1, wherein M>N.

17. The antenna arrangement according to claim 1, wherein min (M, N)≥P.

18. The antenna arrangement according to claim 1, wherein min (M, N) is a multiple of P.

19. The antenna arrangement according to claim 1, wherein the antenna panel is a one-dimensional antenna array.

20. The antenna arrangement according to claim 1, wherein the antenna panel is a two-dimensional antenna array.

21. A network node comprising an antenna arrangement according to claim 1.

22. A wireless terminal comprising an antenna arrangement according to claim 1.

* * * * *